US012007211B2

(12) United States Patent
Quitmeyer et al.

(10) Patent No.: US 12,007,211 B2
(45) Date of Patent: Jun. 11, 2024

(54) MANUALLY RESETTABLE MISSILE FIN LOCK ASSEMBLY

(71) Applicant: HONEYWELL INTERNATIONAL INC., Charlotte, NC (US)

(72) Inventors: James Quitmeyer, Tempe, AZ (US); Timm Hartman, Tempe, AZ (US)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 629 days.

(21) Appl. No.: 17/307,108

(22) Filed: May 4, 2021

(65) Prior Publication Data

US 2022/0357136 A1 Nov. 10, 2022

(51) Int. Cl.
*F42B 10/64* (2006.01)

(52) U.S. Cl.
CPC ..... *F42B 10/64* (2013.01)

(58) Field of Classification Search
CPC .... F42B 10/64; B64C 13/14; Y10T 292/0993; Y10T 292/307
See application file for complete search history.

(56) References Cited

U.S. PATENT DOCUMENTS

| | | | |
|---|---|---|---|
| 4,795,110 | A | 1/1989 | Lang |
| 5,409,185 | A | 4/1995 | Oldakowski |
| 5,950,963 | A | 9/1999 | Speicher et al. |
| 6,250,584 | B1 | 6/2001 | Hsu et al. |
| 6,352,217 | B1 | 3/2002 | Hsu et al. |
| 6,450,444 | B1 | 9/2002 | Sorvino |
| 6,948,685 | B2 | 9/2005 | Hawthorne |
| 7,195,197 | B2 | 3/2007 | Hsu et al. |
| 7,316,370 | B2 | 1/2008 | Sankovic et al. |
| 7,700,902 | B2 | 4/2010 | Mock et al. |
| 8,686,328 | B2 | 4/2014 | Bugge et al. |
| 8,975,566 | B2 | 3/2015 | Black et al. |

(Continued)

FOREIGN PATENT DOCUMENTS

| | | |
|---|---|---|
| GB | 2240954 A | 8/1991 |
| WO | 2020159412 A1 | 8/2020 |

OTHER PUBLICATIONS

Stockholm Company, "Type 1032 Heavy Duty Rack & Pinion Actuator," 2021, downloaded from http://www.rsvpactuators.com/type-1032-rack-and-pinion-actuator.html on Mar. 25, 2021.

(Continued)

*Primary Examiner* — Richard Green
(74) *Attorney, Agent, or Firm* — Lorenz & Kopf LLP

(57) ABSTRACT

A lock assembly includes a housing, a lock shaft, a reset shaft, and a transfer gear. The lock shaft is disposed partially within and extends from the housing and is movable between a lock position and an unlock position. The reset shaft is disposed at least partially within the housing, is spaced apart from the lock shaft, and is movable between a first position and a second position. The transfer gear is disposed between, and engages, the lock shaft and the reset shaft, and is configured to transfer motion between the lock shaft and the reset shaft. When the lock shaft moves from the lock position to the unlock position, the reset shaft is moved from the first position to the second position, and when the reset shaft moves from the second position to the first position, the lock shaft is moved from the unlock position to the lock position.

20 Claims, 5 Drawing Sheets

(56) References Cited

U.S. PATENT DOCUMENTS

| | | | | |
|---|---|---|---|---|
| 9,863,745 | B2 | 1/2018 | DeHart | |
| 10,041,481 | B2 | 8/2018 | Albright | |
| 10,337,219 | B2 * | 7/2019 | Wolf | E05B 65/0085 |

OTHER PUBLICATIONS

Marotta Controls, "Manually Resettable Fin Lock," downloaded from https://marotta.com/products/control-systems/control-actuation-systems/ on Mar. 16, 2021.

* cited by examiner

MANUALLY RESETTABLE MISSILE FIN LOCK ASSEMBLY

TECHNICAL FIELD

The present invention generally relates to a lock assembly, and more particularly relates to a manually resettable missile fin lock assembly.

BACKGROUND

A missile typically includes a fuselage and a plurality of controllable fins that are spaced around, and rotatable relative to, the fuselage. The fins may be coupled to rotatable shafts that extend into the fuselage and engage corresponding motors via, for example, associated gear linkages. The motors are used to control the rotation of the fins to thereby provide aerodynamic steering control during missile flight.

As may be appreciated, accurate missile flight depends on the proper function of the fins. Thus, it is desirable to avoid damage to the fins and associated controls, especially during transport or various other pre-flight handling activities. To do so, most missiles include fin locking mechanisms. The locking mechanisms are used to lock the fins in the null position when the missile is not in use, and to unlock the fins for a flight mission. It is also desirable that the locking mechanisms be configured to unlock the fins for pre-flight, full-stroke testing, and to be resettable to the locked position following the testing. Many current locking mechanisms either do not include this latter functionality or, if they do, are relatively complex and expensive.

Hence, there is a need for relatively simple and relatively inexpensive missile fin lock assembly that not only unlocks the fins for a flight mission, but is also configured to unlock the fins for pre-flight, full-stroke testing, and is resettable to the locked position following the testing. The present invention addresses at least this need.

BRIEF SUMMARY

This summary is provided to describe select concepts in a simplified form that are further described in the Detailed Description. This summary is not intended to identify key or essential features of the claimed subject matter, nor is it intended to be used as an aid in determining the scope of the claimed subject matter.

In one embodiment, a lock assembly includes a housing, a lock shaft, a reset shaft, and a transfer gear. The lock shaft is disposed partially within and extends from the housing and is movable between a lock position and an unlock position. The reset shaft is disposed at least partially within the housing and is spaced apart from the lock shaft. The reset shaft is movable between a first position and a second position. The transfer gear is disposed between, and engages, the lock shaft and the reset shaft, and is configured to transfer motion between the lock shaft and the reset shaft. When the lock shaft moves from the lock position to the unlock position, the reset shaft is moved from the first position to the second position, and when the reset shaft moves from the second position to the first position, the lock shaft is moved from the unlock position to the lock position.

In another embodiment, a lock assembly includes a housing, a lock shaft, a reset shaft, a transfer gear, and a spring. The lock shaft is disposed partially within and extends from the housing. The lock shaft includes lock shaft gear teeth and is movable between a lock position and an unlock position. The reset shaft is disposed at least partially within the housing and is spaced apart from the lock shaft. The reset shaft includes reset shaft gear teeth and is movable between a first position and a second position. The transfer gear is disposed between the lock shaft and the reset shaft. The reset shaft meshes with the lock shaft gear teeth and the reset shaft gear teeth and is configured to transfer motion between the lock shaft and the reset shaft. The spring is disposed within the housing and engages the lock shaft. The spring supplies a spring force to the lock shaft that urges the lock shaft toward the unlock position. When the lock shaft moves from the lock position to the unlock position, the reset shaft is moved from the first position to the second position, and when the reset shaft moves from the second position to the first position, the lock shaft is moved from the unlock position to the lock position.

In yet another embodiment, a missile includes a fuselage, a plurality of movable fins, and a plurality of lock assemblies. The movable fins are disposed on, and are rotatable relative to, the fuselage. The lock assemblies are disposed on the fuselage and each is associated with a different one of the moveable fins. Each lock assembly includes a housing, a lock shaft, a reset shaft, and a transfer gear. The lock shaft is disposed partially within and extends from the housing and is movable between a lock position, in which rotation of the associated movable fin is prevented, and an unlock position, in which rotation of the associated movable fin is allowed. The reset shaft is disposed at least partially within the housing and is spaced apart from the lock shaft. The reset shaft is movable between a first position and a second position. The transfer gear is disposed between, and engages, the lock shaft and the reset shaft, and is configured to transfer motion between the lock shaft and the reset shaft. When the lock shaft moves from the lock position to the unlock position, the reset shaft is moved from the first position to the second position, and when the reset shaft moves from the second position to the first position, the lock shaft is moved from the unlock position to the lock position.

Furthermore, other desirable features and characteristics of the lock assembly will become apparent from the subsequent detailed description and the appended claims, taken in conjunction with the accompanying drawings and the preceding background.

BRIEF DESCRIPTION OF THE DRAWINGS

The present invention will hereinafter be described in conjunction with the following drawing figures, wherein like numerals denote like elements, and wherein.

DETAILED DESCRIPTION

The following detailed description is merely exemplary in nature and is not intended to limit the invention or the application and uses of the invention. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the invention and not to limit the scope of the invention which is defined by the claims. Furthermore, there is no intention to be bound by any expressed or implied theory presented in the preceding technical field, background, brief summary, or the following detailed description.

Figure 1:
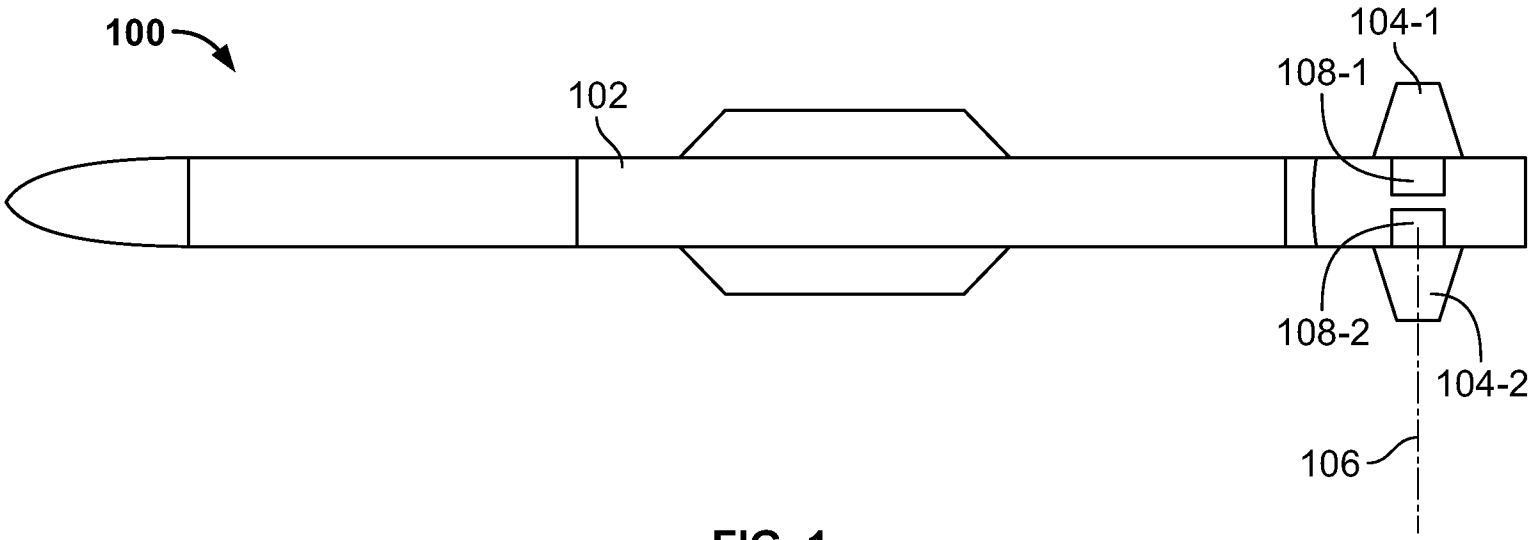
FIG. 1 depicts a simplified schematic representation of one embodiment of a missile.

Referring now to FIG. 1, a simplified schematic representation of one embodiment of a missile 100. The depicted missile 100 includes at least a fuselage 102 and a plurality of movable fins 104. The moveable fins 104 are disposed on, and are rotatable relative to, the fuselage 102 about a rotational axis 106. In the depicted embodiment, the missile 100 includes two movable fins 104 (104-1, 104-2). It will be appreciated, however, that in other embodiments the missile 100 could be implemented with more or less than this number of movable fins 104.

As FIG. 1 also depicts, the missile 100 additionally includes a plurality of lock assemblies 108. The lock assemblies 108 are disposed on the fuselage 102 and each is associated with a different one of the moveable fins 104. Thus, in the depicted embodiment, the missile 100 includes two lock assemblies (108-1, 108-2). It will be appreciated, however, that other embodiments the missile 100 could be implemented with more or less than this number of lock assemblies 108.

Regardless of the number of lock assemblies 108 that are included, each is configured to move between a lock position, in which rotation of its associated movable fin 104 is prevented, and an unlock position, in which rotation of its associated movable fin 104 is allowed. Each lock assembly 108 is also configured to be manually resettable from the unlock position back to the lock position. One embodiment of a lock assembly 108 that may be implemented in the missile 100 and that implements this functionality is depicted in FIGS. 2-6 and will now be described.

Figure 2:
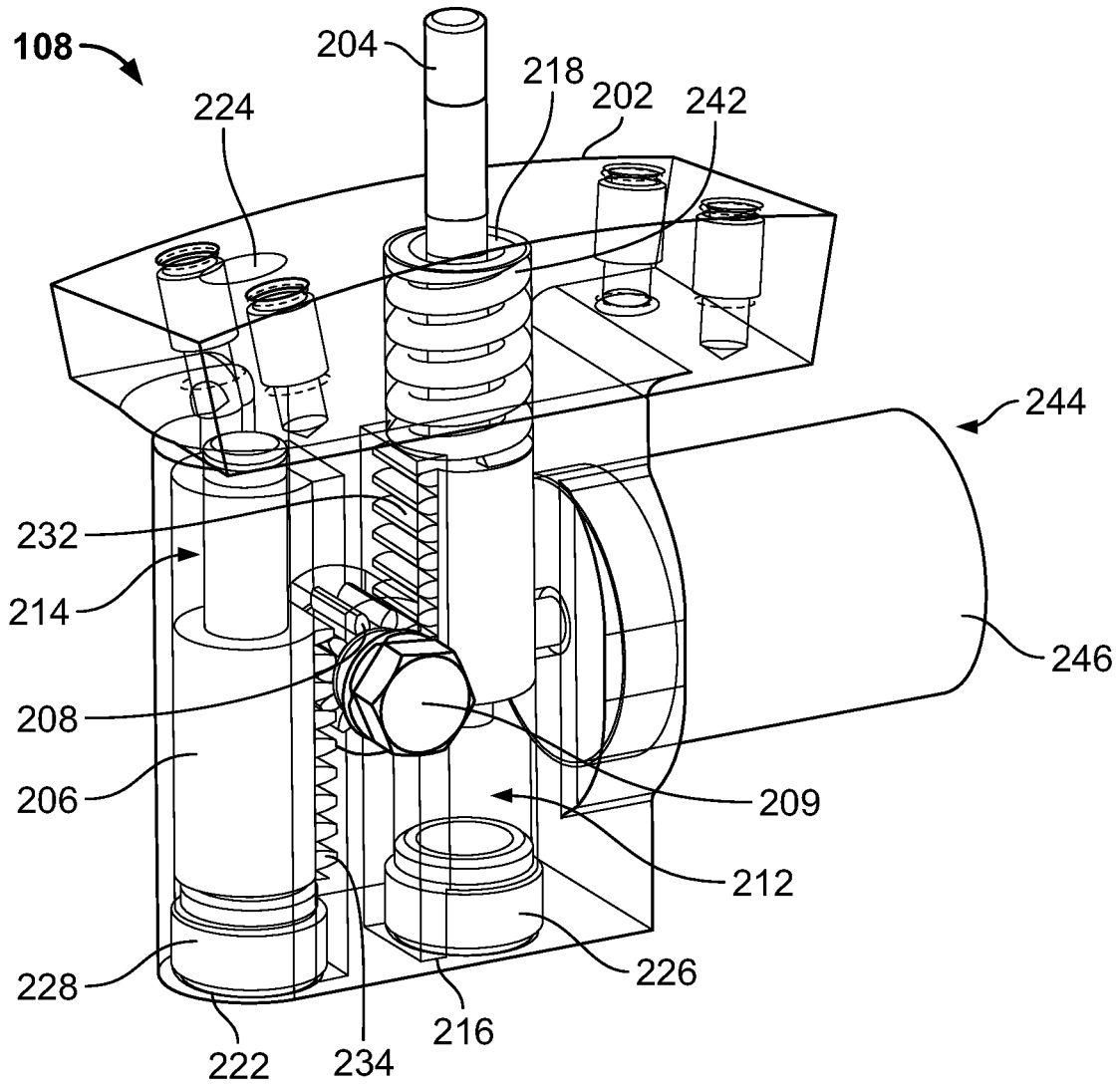
FIGS. 2 and 3 depict perspective views of one embodiment of a lock assembly that may be used in the missile of FIG. 1, with the housing portion depicted in ghosted fashion.
Figure 3:
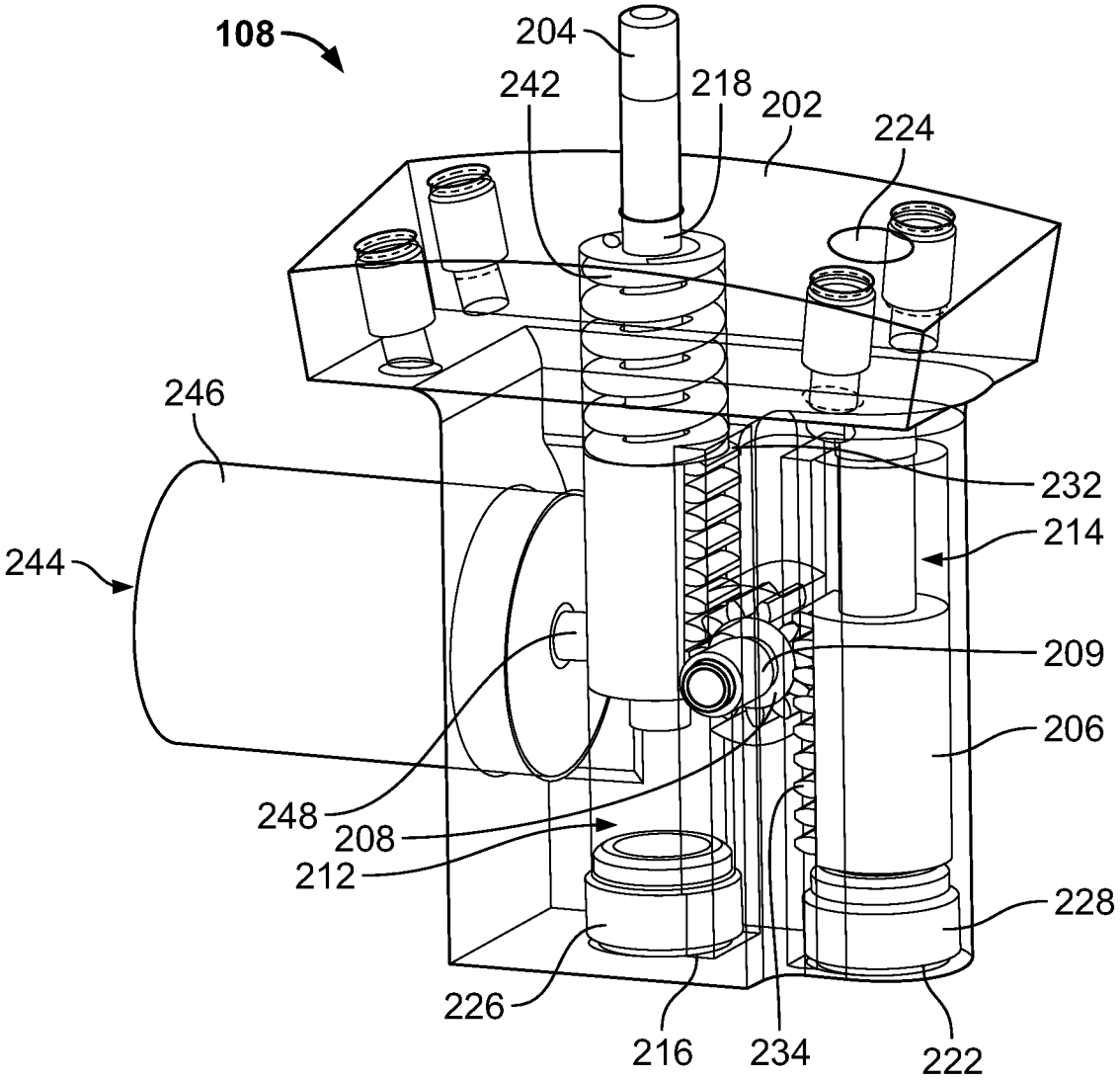

Referring first to FIGS. 2 and 3, it is seen that the depicted lock assembly 108 includes a housing 202, a lock shaft 204, a reset shaft 206, and a transfer gear 208. The housing 202 has a lock shaft cavity 212 and a reset shaft cavity 214 formed therein. The lock shaft cavity 212 includes a first lock shaft cavity opening 216 and a second lock shaft cavity opening 218. Similarly, the reset shaft cavity 214 has a first reset shaft cavity opening 222 and a second reset shaft cavity opening 224. A lock shaft cavity cover 226 is disposed within the first lock shaft cavity opening 216, and a reset shaft cavity cover 228 is disposed within the first reset shaft cavity opening 222.

The lock shaft 204 is disposed partially within, and extends from, the housing 202. More specifically, the lock shaft 204 is disposed within the lock shaft cavity 212, and is movable between a lock position, which is the position depicted in FIGS. 2-4, and an unlock position, which is the position depicted in FIG. 5. The lock shaft 204 may extend from the second lock shaft cavity opening 218 at least when the lock shaft 204 is in the lock position. In the depicted embodiment, however, it is seen that it extends from the second lock shaft cavity opening 218 in both the lock and unlock positions. When installed on the missile of FIG. 1, when the lock shaft 204 is in the lock position, rotation of its associated movable fin 104 is prevented, and when it is in the unlock position, rotation of its associated movable fin 104 is allowed.

The reset shaft 206 is disposed at least partially within the housing 202 and is spaced apart from the lock shaft 204. More specifically, the reset shaft 204 is disposed within the reset shaft cavity 214, and is movable between a first position, which is the position depicted in FIGS. 2-4, and a second position, which is the position depicted in FIG. 5. In the depicted embodiment, the reset shaft 206 remains entirely within the reset shaft cavity 214 both when the reset shaft 206 is in the first position and in the second position. It will be appreciated, however, that in other embodiments, the reset shaft 206 could extend, at least partially, from the second reset shaft cavity opening 224 when it is in the second position.

The transfer gear 208 is disposed between, and engages, the lock shaft 204 and the reset shaft 206. The transfer gear 208 is rotationally mounted within the housing 202 via suitable rotational hardware 209, and is configured to transfer motion between the lock shaft 204 and the reset shaft 206. To facilitate this functionality, it is seen that the lock shaft 204 has lock shaft gear teeth 232 formed thereon, the reset shaft 206 has reset shaft gear teeth 234 formed thereon, and the transfer gear 208 meshes with the lock shaft gear teeth 232 and the reset shaft gear teeth 234. Thus, when the lock shaft 204 moves from the lock position to the unlock position, the reset shaft 206 is moved from the first position to the second position. Moreover, when the reset shaft is moved from the second position to the first position, the lock shaft 204 is moved from the unlock position to the lock position.

Figure 4:
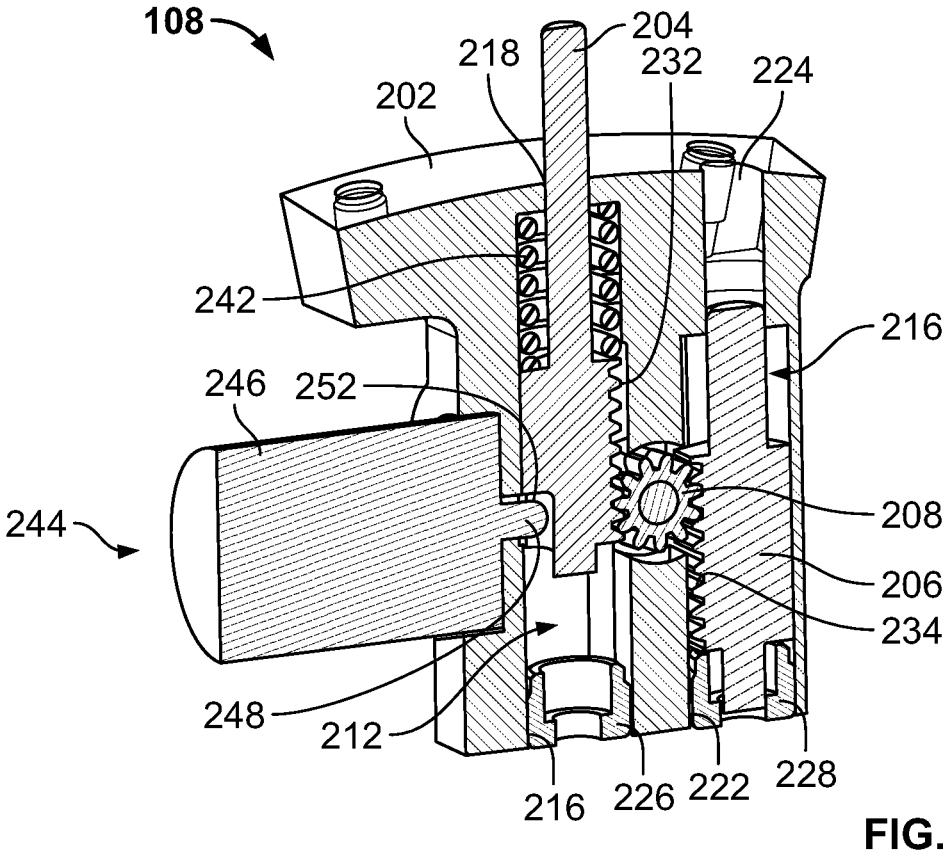
FIG. 4 depicts a cross-section view of the lock assembly of FIGS. 2 and 3 with the lock assembly in the lock position.
Figure 5:
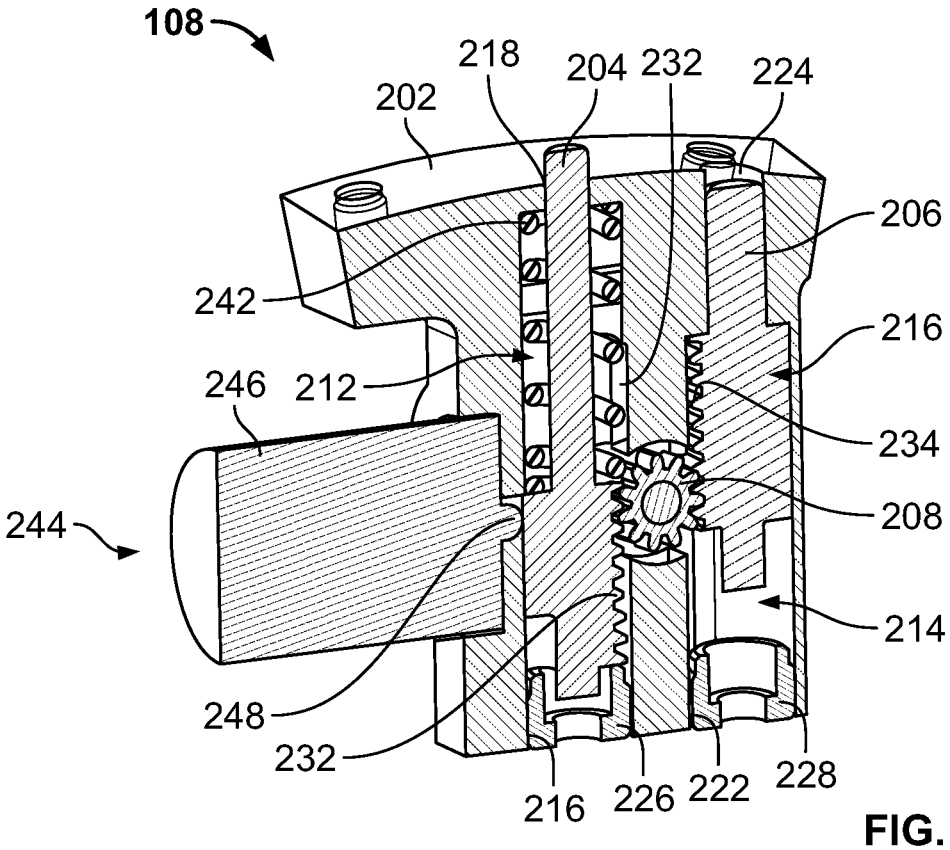
FIG. 5 depicts the same cross-section view of the lock assembly shown in FIG. 4, but with the lock assembly in the unlock position.
Figure 6:
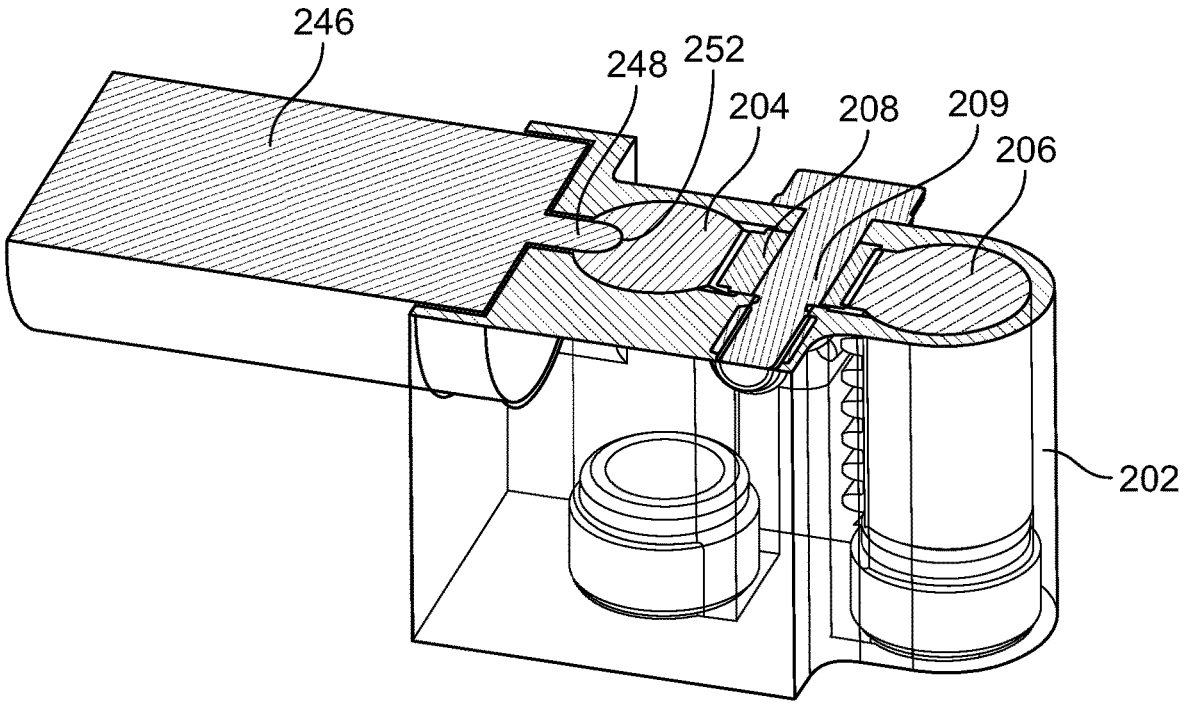
FIG. 6 depicts another cross-section view of the lock assembly of FIGS. 2 and 3 with the lock assembly in the lock position.

As FIGS. 2-4 further depict, the lock assembly 108 additionally includes a spring 242 and an actuation mechanism 244. The spring 242 is disposed within the housing, and more specifically within the lock shaft cavity 212, and engages the lock shaft 204 and the housing 202. The spring 242 is configured to supply a spring force to the lock shaft 204 that urges the lock shaft 204 toward the unlock position. Although the depicted spring 242 is implemented using a coil spring, it will be appreciated that in other embodiments it could be implemented using any one of numerous other types of springs.

The actuation mechanism 244 is coupled to the housing 202 and is movable between an extend position and a retract position. In the extend position, which is the position depicted in FIGS. 2-4, the actuation mechanism 244 engages the lock shaft 204 and, when the lock shaft 204 is in the lock position, the actuation mechanism 244 retains the lock shaft 204 in the lock position against the spring force. In the retract position, which is the position depicted in FIG. 5, the actuation mechanism 244 disengages the lock shaft 204. Thus, when the lock shaft 204 is in the lock position, the lock shaft 204 responds to the spring force and moves to the unlock position.

In the depicted embodiment, the actuation mechanism 244 is implemented using a solenoid 246 and a pin 248. The solenoid 246 is preferably configured to be spring-loaded to the extend position when it is deenergized. Thus, whenever the solenoid 246 is deenergized, it will be in the extend position. As shown most clearly in FIGS. 4 and 6, when it is in the extend position, and the lock shaft 204 is in the lock position, the pin 248 is disposed within a pin opening 252 that is formed in the lock shaft 204. To move the actuation mechanism 244 to the retract position, the solenoid 246 is energized, preferably only momentarily, which causes the pin 248 to withdraw from the pin opening 252. The spring force of the spring 242 thus moves lock shaft 204 to the unlock position. It should be noted that in other embodiments, the solenoid 246 could be configured to be spring-loaded to the retract position when it is deenergized.

As previously noted, the lock assembly 108 is configured to be manually resettable from the unlock position back to the lock position. To do so, the reset shaft 206 must be moved from the second position back to the first position. As was also previously noted, the reset shaft 206 in the depicted embodiment remains entirely within the reset shaft cavity 214 both when the reset shaft 206 is in the first position and in the second position. Thus, to reset the lock assembly 108 back to the lock position, an appropriately sized tool may be inserted into the second reset shaft cavity opening 224 and used to move the reset shaft 206 back to the first position, compressing the spring 242 back to its energized position. In the depicted embodiment, when the reset shaft 206 is back in the first position, the pin 248 is aligned with, and is thus again disposed in, the pin opening 252, thereby retaining the lock shaft 204 in the lock position.

The lock assembly 108 disclosed herein is relatively simple and relatively inexpensive. When used in the context of a missile fin locking device, it not only unlocks the fins for a flight mission, but is also configured to unlock the fins for pre-flight, full-stroke testing, and is resettable to the lock position following the testing.

In this document, relational terms such as first and second, and the like may be used solely to distinguish one entity or action from another entity or action without necessarily requiring or implying any actual such relationship or order between such entities or actions. Numerical ordinals such as "first," "second," "third," etc. simply denote different singles of a plurality and do not imply any order or sequence unless specifically defined by the claim language. The sequence of the text in any of the claims does not imply that process steps must be performed in a temporal or logical order according to such sequence unless it is specifically defined by the language of the claim. The process steps may be interchanged in any order without departing from the scope of the invention as long as such an interchange does not contradict the claim language and is not logically nonsensical.

Furthermore, depending on the context, words such as "connect" or "coupled to" used in describing a relationship between different elements do not imply that a direct physical connection must be made between these elements. For example, two elements may be connected to each other physically, electronically, logically, or in any other manner, through one or more additional elements.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A fin lock assembly for locking fins of a missile when not in use, comprising:

a movable fin;

a housing;

a lock shaft disposed partially within and extending from the housing, the lock shaft movable between a lock position, in which rotation of the movable fin is prevented, and an unlock position, in which rotation of the movable fin is allowed;

a reset shaft disposed at least partially within the housing and spaced apart from the lock shaft, the reset shaft movable between a first position and a second position; and a transfer gear disposed between, and engaging, the lock shaft and the reset shaft, the transfer gear configured to transfer motion between the lock shaft and the reset shaft, wherein:

when the lock shaft moves from the lock position to the unlock position, the reset shaft is moved from the first position to the second position, and when the reset shaft moves from the second position to the first position, the lock shaft is moved from the unlock position to the lock position.

2. The lock assembly of claim 1, further comprising:

a spring disposed within the housing and engaging the lock shaft, the spring supplying a spring force to the lock shaft that urges the lock shaft toward the unlock position.

3. The lock assembly of claim 2, further comprising:

an actuation mechanism coupled to the housing and movable between an extend position and a retract position, wherein:

in the extend position, the actuation mechanism engages the lock shaft and, when the lock shaft is in the lock position, retains the lock shaft in the lock position against the spring force, and in the retract position, the actuation mechanism disengages the lock shaft and, when the lock shaft is in the lock position, allows the lock shaft to respond to the spring force and move to the unlock position.

4. The lock assembly of claim 3, wherein the actuation mechanism comprises a solenoid.

5. The lock assembly of claim 4, wherein the actuation mechanism is:

in the extend position whenever the solenoid is deenergized; and in the retract position whenever the solenoid is energized.

6. The lock assembly of claim 1, wherein:

the lock shaft includes lock shaft gear teeth;

the reset shaft includes reset shaft gear teeth; and the transfer gear meshes with the lock shaft gear teeth and the reset shaft gear teeth.

7. The lock assembly of claim 1, further comprising:

a lock shaft cavity formed in the housing and having the lock shaft disposed therein, the lock shaft cavity including a first lock shaft cavity opening and a second lock shaft cavity opening;

a reset shaft cavity formed in the housing and having the reset shaft disposed therein, the reset shaft cavity including a first reset shaft cavity opening and a second reset shaft cavity opening;

a lock shaft cavity cover disposed within the first lock shaft cavity opening; and a reset shaft cavity cover disposed within the first reset shaft cavity opening.

8. The lock assembly of claim 7, wherein the lock shaft extends from the second lock shaft cavity opening at least when the lock shaft is in the lock position.

9. The lock assembly of claim 7, wherein the reset shaft remains entirely within the reset shaft cavity when the reset shaft is in the first position and when the reset shaft is in the second position.

10. A fin lock assembly for locking fins of a missile when not in use, comprising:

a movable fin;

a housing;

a lock shaft disposed partially within and extending from the housing, the lock shaft including lock shaft gear teeth and movable between a lock position, in which rotation of the movable fin is prevented, and an unlock position, in which rotation of the movable fin is allowed;

a reset shaft disposed at least partially within the housing and spaced apart from the lock shaft, the reset shaft including reset shaft gear teeth and movable between a first position and a second position;

a transfer gear disposed between the lock shaft and the reset shaft, the transfer gear meshing with the lock shaft gear teeth and the reset shaft gear teeth and configured to transfer motion between the lock shaft and the reset shaft; and a spring disposed within the housing and engaging the lock shaft, the spring supplying a spring force to the lock shaft that urges the lock shaft toward the unlock position, wherein:

when the lock shaft moves from the lock position to the unlock position, the reset shaft is moved from the first position to the second position, and when the reset shaft moves from the second position to the first position, the lock shaft is moved from the unlock position to the lock position.

11. The lock assembly of claim 10, further comprising:

an actuation mechanism coupled to the housing and movable between an extend position and a retract position, wherein:

in the extend position, the actuation mechanism engages the lock shaft and, when the lock shaft is in the lock position, retains the lock shaft in the lock position against the spring force, and in the retract position, the actuation mechanism disengages the lock shaft and, when the lock shaft is in the lock position, allows the lock shaft to respond to the spring force and move to the unlock position.

12. The lock assembly of claim 11, wherein the actuation mechanism comprises a solenoid.

13. The lock assembly of claim 12, wherein the actuation mechanism is:

in the extend position whenever the solenoid is deenergized; and in the retract position whenever the solenoid is energized.

14. The lock assembly of claim 10, further comprising:

a lock shaft cavity formed in the housing and having the lock shaft disposed therein, the lock shaft cavity including a first lock shaft cavity opening and a second lock shaft cavity opening;

a reset shaft cavity formed in the housing and having the reset shaft disposed therein, the reset shaft cavity including a first reset shaft cavity opening and a second reset shaft cavity opening;

a lock shaft cavity cover disposed within the first lock shaft cavity opening; and a reset shaft cavity cover disposed within the first reset shaft cavity opening.

15. The lock assembly of claim 14, wherein the lock shaft extends from the second lock shaft cavity opening at least when the lock shaft is in the lock position.

16. The lock assembly of claim 14, wherein the reset shaft remains entirely within the reset shaft cavity when the reset shaft is in the first position and when the reset shaft is in the second position.

17. A missile, comprising:

a fuselage;

a plurality of movable fins disposed on, and rotatable relative to, the fuselage;

a plurality of lock assemblies disposed on the fuselage, each of the lock assemblies associated with a different one of the moveable fins, each lock assembly comprising:

a housing;

a lock shaft disposed partially within and extending from the housing, the lock shaft movable between a lock position, in which rotation of the associated movable fin is prevented, and an unlock position, in which rotation of the associated movable fin is allowed;

a reset shaft disposed at least partially within the housing and spaced apart from the lock shaft, the reset shaft movable between a first position and a second position; and a transfer gear disposed between, and engaging, the lock shaft and the reset shaft, the transfer gear configured to transfer motion between the lock shaft and the reset shaft, wherein:

when the lock shaft moves from the lock position to the unlock position, the reset shaft is moved from the first position to the second position, and when the reset shaft moves from the second position to the first position, the lock shaft is moved from the unlock position to the lock position.

18. The missile of claim 17, wherein each lock assembly further comprises:

a spring disposed within the housing and engaging the lock shaft, the spring supplying a spring force to the lock shaft that urges the lock shaft toward the unlock position.

19. The missile of claim 18, wherein each lock assembly further comprises:

an actuation mechanism coupled to the housing and movable between an extend position and a retract position, wherein:

in the extend position, the actuation mechanism engages the lock shaft and, when the lock shaft is in the lock position, retains the lock shaft in the lock position against the spring force, and in the retract position, the actuation mechanism disengages the lock shaft and, when the lock shaft is in the lock position, allows the lock shaft to respond to the spring force and move to the unlock position.

20. The missile of claim 17, wherein each lock assembly further comprises:

lock shaft gear teeth formed on lock shaft;

reset shaft gear teeth formed on the reset shaft; and the transfer gear meshes with the lock shaft gear teeth and the reset shaft gear teeth.

* * * * *